US011519327B1

(12) United States Patent
Lemancik et al.

(10) Patent No.: US 11,519,327 B1
(45) Date of Patent: Dec. 6, 2022

(54) SYSTEMS AND METHODS FOR ENHANCING FEATURES OF A MARINE PROPULSION SYSTEM

(71) Applicant: Brunswick Corporation, Mettawa, IL (US)

(72) Inventors: Michael J. Lemancik, Oshkosh, WI (US); Jason S. Arbuckle, Horicon, WI (US); Matthew W. Snyder, Fond du Lac, WI (US); Robert R. Osthelder, Omro, WI (US); Steven J. Andrasko, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 864 days.

(21) Appl. No.: 16/418,470

(22) Filed: May 21, 2019

Related U.S. Application Data

(63) Continuation-in-part of application No. 15/378,778, filed on Dec. 14, 2016, now abandoned.

(51) Int. Cl.

| | |
|---|---|
| ***F02B 61/04*** | (2006.01) |
| ***B63H 20/00*** | (2006.01) |
| ***B63H 20/08*** | (2006.01) |
| ***B63H 20/32*** | (2006.01) |

(52) U.S. Cl.
CPC ..... *F02B 61/045* (2013.01); *B63H 20/002* (2013.01); *B63H 20/08* (2013.01); *B63H 20/32* (2013.01)

(58) Field of Classification Search
CPC ..... F02B 61/045; B63H 20/002; B63H 20/08; B63H 20/32
See application file for complete search history.

(56) References Cited

U.S. PATENT DOCUMENTS

| | | | |
|---|---|---|---|
| 4,005,674 | A | 2/1977 | Davis |
| 4,303,978 | A | 12/1981 | Shaw et al. |
| 5,884,213 | A | 3/1999 | Carlson |
| 6,220,078 | B1 | 4/2001 | Brammer et al. |
| 6,275,765 | B1 | 8/2001 | Divljakovic et al. |
| 6,285,947 | B1 | 9/2001 | Divljakovic et al. |
| 6,302,046 | B1 | 10/2001 | Magee et al. |
| 6,322,404 | B1 | 11/2001 | Magee et al. |

(Continued)

OTHER PUBLICATIONS

Zhao, Yueming, "GPS/IMU Integrated System for Land Vehicle Navigation based on MEMS", Royal Institute of Technology, Division of Geodesy and Geoinformatics, Sweden, Sep. 2011.

(Continued)

*Primary Examiner* — Stephen P Avila
(74) *Attorney, Agent, or Firm* — Andrus Intellectual Property Law, LLP

(57) ABSTRACT

A marine propulsion system for a marine vessel has an outboard motor including a cowl covering an internal combustion engine that powers the outboard motor and an accelerometer mounted to the outboard motor. A control module is communicatively connected to the accelerometer. The control module receives information regarding an acceleration of the outboard motor from the accelerometer. The control module uses the information regarding the acceleration of the outboard motor to do at least one of the following: determine an angle of the outboard motor with respect to gravity; determine an amount of oil in an oil sump of the outboard motor; and determine if a reading of the amount of oil in the oil sump is accurate.

19 Claims, 7 Drawing Sheets

(56) References Cited

U.S. PATENT DOCUMENTS

| | | | |
|---|---|---|---|
| 6,859,751 | B2 | 2/2005 | Cardarelli |
| 7,267,068 | B2 | 9/2007 | Bradley et al. |
| 7,305,928 | B2 | 12/2007 | Bradley et al. |
| 7,416,456 | B1 | 8/2008 | Gonring et al. |
| 8,417,399 | B2 | 4/2013 | Arbuckle et al. |
| 8,439,800 | B1 | 5/2013 | Bazan et al. |
| 8,478,464 | B2 | 7/2013 | Arbuckle et al. |
| 8,657,638 | B1 | 2/2014 | Gonring |
| 8,694,248 | B1 | 4/2014 | Arbuckle et al. |
| 8,761,976 | B2 | 6/2014 | Salmon et al. |
| 8,924,054 | B1 | 12/2014 | Arbuckle et al. |
| 9,039,468 | B1 | 5/2015 | Arbuckle et al. |
| 9,150,294 | B2 | 10/2015 | Ito et al. |
| 9,193,429 | B1 | 11/2015 | Langenfeld |
| 9,248,898 | B1 | 2/2016 | Kirchhoff et al. |
| 9,278,740 | B1 | 3/2016 | Andrasko et al. |
| 9,359,057 | B1 | 6/2016 | Andrasko et al. |
| 9,377,780 | B1 | 6/2016 | Arbuckle et al. |
| 9,751,605 | B1 | 9/2017 | Anschuetz et al. |
| 9,919,781 | B1 | 3/2018 | Andrasko et al. |
| 9,932,098 | B1 | 4/2018 | Andrasko et al. |
| 2007/0006101 | A1 | 1/2007 | Michaels |
| 2007/0008186 | A1 | 1/2007 | Michaels et al. |
| 2010/0211259 | A1 | 8/2010 | McClellan |
| 2010/0256845 | A1 | 10/2010 | Mizutani et al. |
| 2010/0286891 | A1 | 11/2010 | Huang et al. |
| 2014/0267006 | A1 | 9/2014 | Raffa et al. |
| 2015/0201867 | A1 | 7/2015 | Peindl et al. |
| 2017/0255205 | A1 | 9/2017 | Hashizume et al. |

OTHER PUBLICATIONS

Fisher, Christopher J., "Using an Accelerometer for Inclination Sensing," Convergence Promotions LLC, May 6, 2011, web article, available at https://www.digikey.com/en/articles/techzone/2011/may/using-an-accelerometer-for-inclination-sensing.

ANILM3, "Arduino IMU: Pitch & Roll from an Accelerometer," The C Continuum, Sep. 24, 2012, web article, available at https://theccontinuum.com/2012/09/24/arduino-imu-pitch-roll-from-accelerometer/#docs.

| | Oil Sensor Data |
|---|---|
| Outboard Angle | Oil Volume |

SYSTEMS AND METHODS FOR ENHANCING FEATURES OF A MARINE PROPULSION SYSTEM

CROSS-REFERENCE TO RELATED APPLICATION

The present application is a continuation-in-part of U.S. application Ser. No. 15/378,778, filed Dec. 14, 2016, which is hereby incorporated herein by reference in its entirety.

FIELD

The present disclosure relates to marine propulsion systems including one or more outboard motors coupled to the transom of a marine vessel.

BACKGROUND

U.S. Pat. No. 4,005,674, which is incorporated herein by reference, discloses a pivot position sensor sensing outboard motor trim that includes a housing within which a pair of U-shaped movable contacts are secured in axially spaced relation on an operating rod which extends outwardly of the housing. The housing is attached by the motor. The end of the rod is interconnected by a flexible cable to a clamp coupler affixed to the tilt tube or shaft. The cable extends over the collar and wraps and unwraps thereon as the motor pivots to position the rod with respect to the motor. The fixed housing is provided with a chamber having a pair of wound linear resistor units secured in longitudinal recesses on opposite sides of the chamber and engaged by one of said contacts. At ninety degrees therefrom, a pair of limit contact strips are mounted in offset recesses on opposite sides of the chamber and connected by the other contact. At a preselected up-tilted position, the limit contacts separate from the strips and open the circuit therebetween to terminate up-trim drive.

U.S. Pat. No. 6,275,765, which is incorporated herein by reference, discloses a method for monitoring an apparatus, such as a marine propulsion system, and determining how various measurements of indicator parameters should be compared to reference magnitudes of those indicator parameters. In addition, the method monitors the usage time of the apparatus at various operating conditions to determine whether or not calculated reference magnitudes should be used to determine appropriate and inappropriate power spectral density profiles for various indicator parameters.

U.S. Pat. No. 6,285,947, which is incorporated herein by reference, discloses that power spectral densities are taken at periodic intervals for preselected indicator parameters and these power spectral density profiles are compared to a reference magnitude of a power spectral density profile for purposes of prognosticated future failures. The power spectral density profile can be for any one of a plurality of indicator profiles, such as an accelerometer output, the output of a pressure sensor, or a voltage output from an ignition system.

U.S. Pat. No. 6,302,046, which is incorporated herein by reference, discloses a steering sensor system provided for a marine vessel in which a rotational position sensor is attached to a guide member that rotates about the central axis of the rotor of the rotational position sensor. A pin is attached to a moveable portion of the steering actuator and slidably disposed within a slot formed in the guide member. The pin is slidably within the slot as the moveable portion of the steering actuator moves along an arcuate path that does not have the same center of rotation as the rotation of the rotatable portion of the rotational position sensor. The sliding of the pin within the slot of the guide member accommodates these different radii of curvature.

U.S. Pat. No. 6,322,404, which is incorporated herein by reference, discloses a Hall effect rotational position sensor mounted on a pivotable member of a marine propulsion system. A rotatable portion of the rotational position sensor is attached to a drive structure of the marine propulsion system. Relative movement between the pivotable member, such as a gimbal ring, and the drive structure, such as the outboard drive portion of the marine propulsion system, cause relative movement between the rotatable and stationary portions of the rotational position sensor. As a result, signals can be provided which are representative of the angular position between the drive structure and the pivotable member.

U.S. Pat. No. 7,267,068, which is incorporated herein by reference, discloses a that marine vessel is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 8,439,800, which is incorporated herein by reference, discloses a shift control system for a marine drive that applies partial clutch engagement pressure upon initial shifting from forward to reverse to prevent stalling of the engine otherwise caused by applying full clutch engagement pressure upon shifting from forward to reverse.

U.S. Pat. No. 8,478,464, which is incorporated herein by reference, discloses systems and methods for orienting a marine vessel to enhance available thrust in a station keeping mode. A control device having a memory and a programmable circuit is programmed to control operation of a plurality of marine propulsion devices to maintain orientation of a marine vessel in a selected global position. The control device is programmed to calculate a direction of a resultant thrust vector associated with the plurality of marine propulsion devices that is necessary to maintain the vessel in the selected global position. The control device is programmed to control operation of the plurality of marine propulsion devices to change the actual heading of the marine vessel to align the actual heading with the thrust vector.

U.S. Pat. No. 8,657,638, which is incorporated herein by reference, discloses systems and methods for determining oil level in a marine outboard motor having an internal combustion engine. A control circuit determines whether oil has drained back into a sump from the internal combustion engine. An oil sensor senses an oil level in the sump. The control circuit calculates a characteristic of the actual oil level of the outboard motor based upon the oil level after the oil has drained back into the sump and based upon a trim position of the outboard motor.

U.S. Pat. No. 8,694,248, which is incorporated herein by reference, discloses systems and methods for monitoring the accuracy of a global positioning system (GPS) receiver in a marine vessel utilizing a GPS receiver receiving a plurality of satellite signals, calculating a global position of the GPS receiver based on the plurality of signals, and determining a signal to noise ratio (SNR) of each signal in the plurality of signals. A control circuit having a computer readable medium having executable code is connected to the GPS receiver by a communication link. The control circuit calculates an average SNR of the plurality of signals and compares the average SNR to a threshold SNR. In one example the threshold SNR varies depending upon a number of satellites sending the plurality of signals and a speed at which the marine vessel is traveling.

U.S. Pat. No. 9,039,468, which is incorporated herein by reference, discloses a system that controls speed of a marine vessel that includes first and second propulsion devices that produce first and second thrusts to propel the marine vessel. A control circuit controls orientation of the propulsion devices between an aligned position in which the thrusts are parallel and an unaligned position in which the thrusts are non-parallel. A first user input device is moveable between a neutral position and a non-neutral detent position. When the first user input device is in the detent position and the propulsion devices are in the aligned position, the thrusts propel the marine vessel in a desired direction at a first speed. When a second user input device is actuated while the first user input device is in the detent position, the propulsion devices move into the unaligned position and propel the marine vessel in the desired direction at a second, decreased speed without altering the thrusts.

U.S. Pat. No. 9,193,429, which is incorporated herein by reference, discloses systems and methods for indicating oil level in an outboard motor to an operator. An outboard motor has an internal combustion engine that drains oil to a sump; a sensor that senses oil level in the sump; and an input device and an indicator on the outboard motor. Actuation of the input device causes the sensor to determine the oil level, and then the indicator to indicate to the oil level to the operator.

U.S. Pat. No. 9,278,740, which is incorporated herein by reference, discloses a system for controlling an attitude of a marine vessel having first and second trim tabs that includes a controller having vessel roll and pitch control sections. The pitch control section compares an actual vessel pitch angle to a predetermined desired vessel pitch angle and outputs a deployment setpoint that is calculated to achieve the desired pitch angle. The roll control section compares an actual vessel roll angle to a predetermined desired vessel roll angle, and outputs a desired differential between the first and second deployments that is calculated to maintain the vessel at the desired vessel roll angle. When the controller determines that the magnitude of a requested vessel turn is greater than a first predetermined threshold, the controller decreases the desired differential between the first and second deployments, and accounts for the decreased desired differential deployment in its calculation of the first and second deployments.

U.S. Pat. No. 9,932,098, which is incorporated herein by reference, discloses systems and methods for reducing steering pressures of marine propulsion device steering actuators. First and second sensors sense first and second conditions of first and second steering actuators. A third sensor senses an operating characteristic of the marine vessel. A controller is in signal communication with the first, second, and third sensors. In response to the marine vessel travelling generally straight ahead, the controller determines a target toe angle between the first and second marine propulsion devices based on the operating characteristic. The controller commands the first and second steering actuators to position the first and second marine propulsion devices at the target toe angle. The controller thereafter gradually adapts the target toe angle between the first and second marine propulsion devices until the controller determines that an absolute difference between the first condition and the second condition reaches a calibrated value.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure relates to a marine propulsion system for a marine vessel. The marine propulsion system comprises an outboard motor including a cowl covering an internal combustion engine that powers the outboard motor. At least one sensor is coupled to the outboard motor. A control module is in signal communication with the at least one sensor. The at least one sensor is attached to one of the engine and the cowl. The at least one sensor provides information related to a pitch of the one of the engine and the cowl to the control module. The control module uses the information related to the pitch of the one of the engine and the cowl to do at least one of the following: determine an angle of the outboard motor with respect to gravity; determine an amount of oil in an oil sump of the outboard motor; and determine if a reading related to the amount of oil in the oil sump is accurate.

According to another example of the present disclosure, a marine propulsion system for a marine vessel comprises an outboard motor including a cowl covering an internal combustion engine that powers the outboard motor and an accelerometer mounted to the outboard motor. A control module is communicatively connected to the accelerometer. The control module receives information regarding an acceleration of the outboard motor from the accelerometer. The control module uses the information regarding the acceleration of the outboard motor to do at least one of the following: determine an angle of the outboard motor with respect to gravity; determine an amount of oil in an oil sump of the outboard motor; and determine if a reading of the amount of oil in the oil sump is accurate.

BRIEF DESCRIPTION OF THE DRAWINGS

Examples of systems and methods for enhancing features of a marine propulsion system are described with reference to the following Figures. The same numbers are used throughout the Figures to reference like features and like components.

DETAILED DESCRIPTION

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC § 112(f) only if the terms "means for" or "step for" are explicitly recited in the respective limitation.

Figure 1:
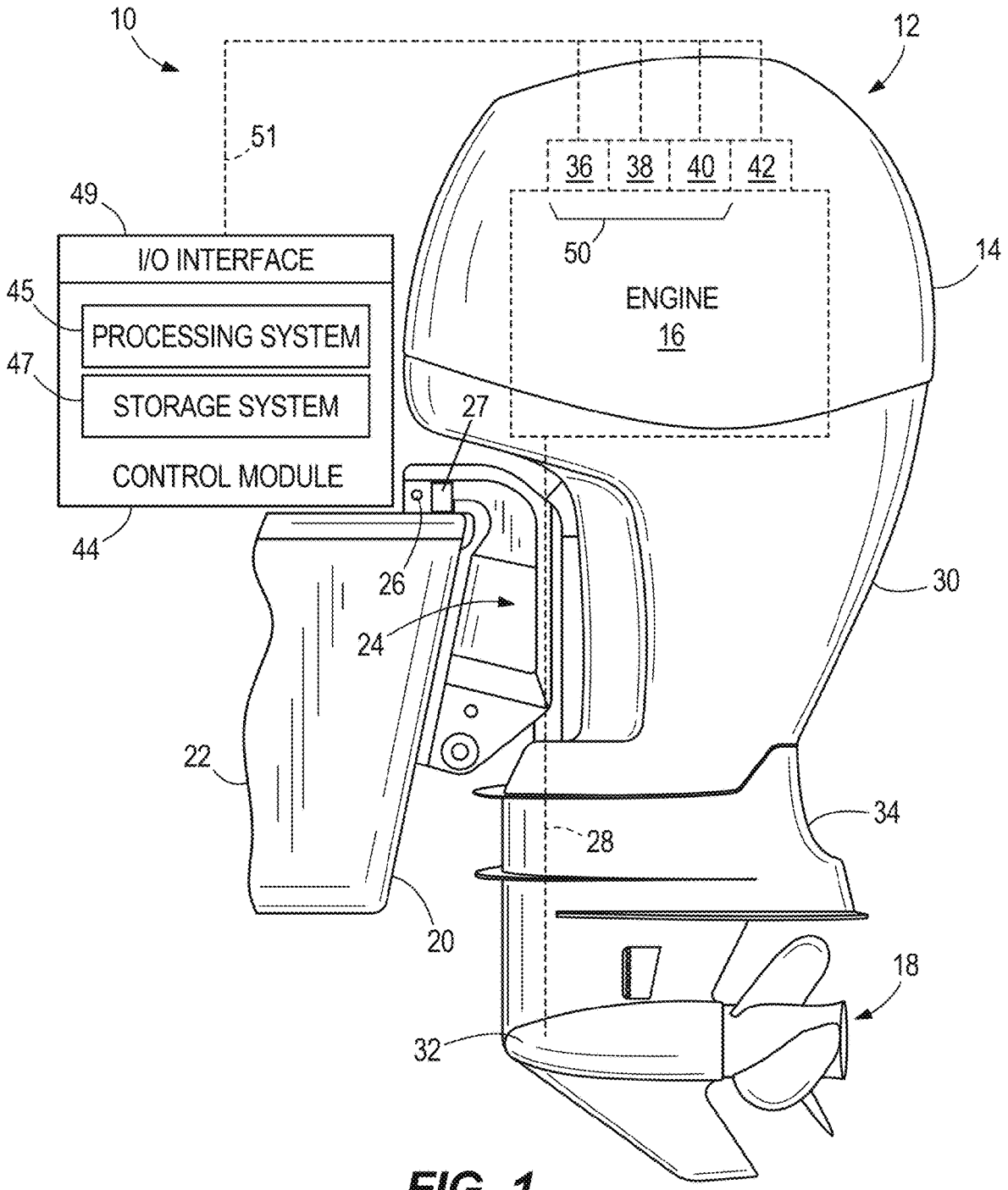
FIG. 1 illustrates one example of an outboard motor having a propulsion control system associated therewith.

FIG. 1 illustrates one example of a marine propulsion system 10 according to the present disclosure. The marine propulsion system 10 includes an outboard motor 12 including a cowl 14 covering an internal combustion engine 16 that is coupled to and powers a propeller 18. More specifically, the engine 16 is supported on, for example, an adapter plate or other support component (not shown), which is coupled to a transom 20 of a marine vessel 22 by way of a mounting assembly 24. The mounting assembly 24 is bolted to the transom 20 and supports the outboard motor 12 for rotation about a horizontal tilt-trim axis 26 and a vertical steering axis 28. A midsection housing 30 covers the adapter plate or other support component as well as a drive shaft (not shown) that extends from where it is coupled to a crankshaft of the engine 16 into a gear case 32 of a lower unit 34. The gear case 32 houses a gear set for transferring rotation of the drive shaft to a propeller shaft, which is in turn coupled to the propeller 18. Other arrangements for the outboard motor 12 are contemplated, and the exact description and arrangement of components shown and described herein is not limiting on the scope of the present disclosure.

The marine propulsion system 10 of the present disclosure further includes at least one motion sensor 36 and at least one orientation sensor 38 coupled to the outboard motor 12. The system 10 may also include at least one directional sensor 40 and a global positioning system (GPS) receiver 42. A control module 44 is provided in signal communication with the at least one motion sensor 36, the at least one orientation sensor 38, the at least one directional sensor 40, and the GPS receiver 42. Note that the connections shown herein by dashed lines are merely exemplary, and fewer, more, or different connections between the sensors 36, 38, 40, the GPS receiver 42, and the control module 44 could be provided.

Figure 2:
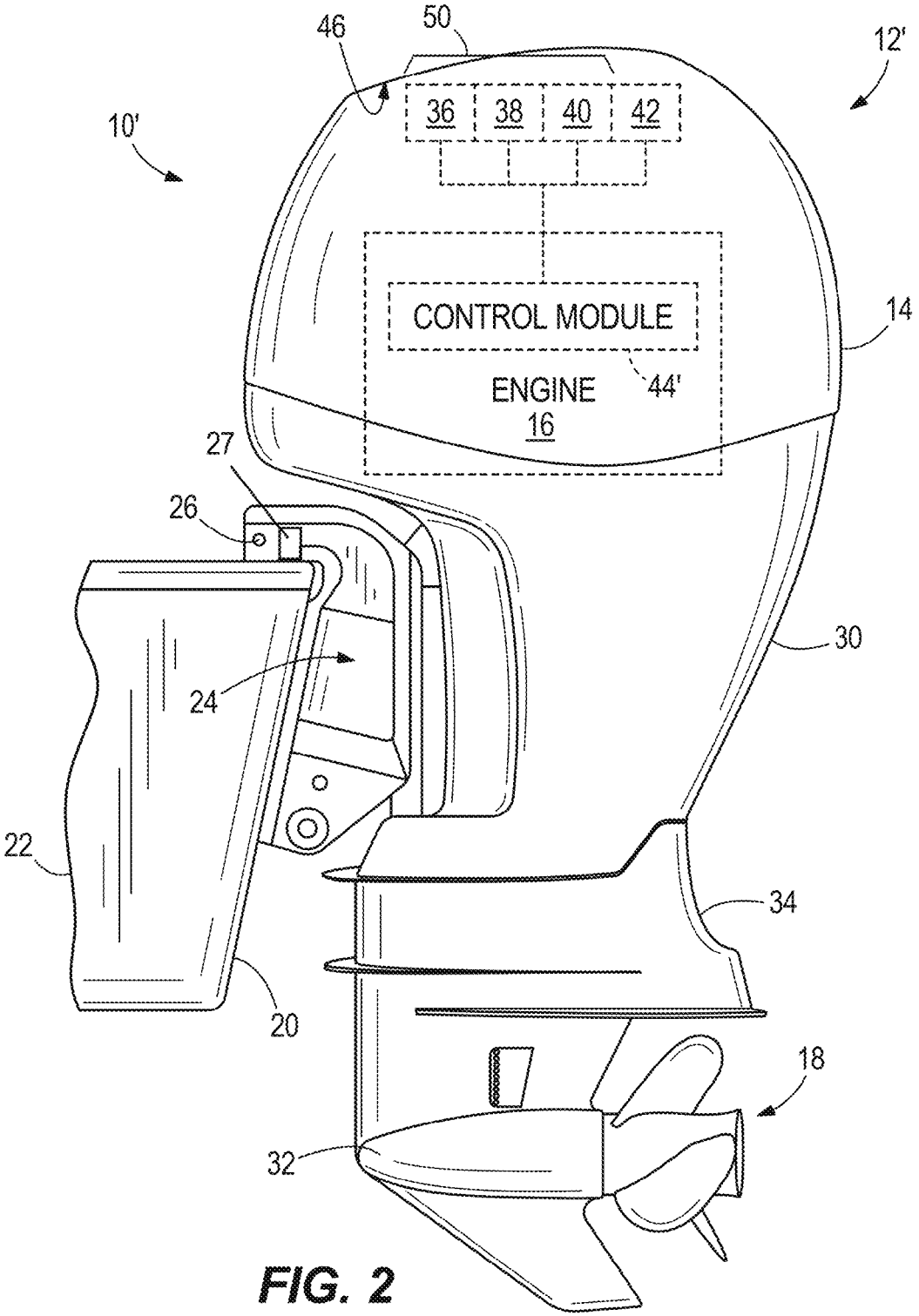
FIG. 2 illustrates another example of an outboard motor having a propulsion control system associated therewith.

According to the example of FIG. 1, the at least one motion sensor 36, the at least one orientation sensor 38, the at least one directional sensor 40, and the GPS receiver 42 are attached to the engine 16. However, the sensors 36, 38, 40 and GPS receiver 42 could instead be attached to the cowl 14, as shown in FIG. 2. For example, FIG. 2 shows the motion sensor 36, orientation sensor 38, directional sensor 40, and GPS receiver 42 coupled to an underside 46 of the cowl 14. This protects the sensors 36, 38, 40 and GPS receiver 42 from water intrusion. Note that in both the examples of FIGS. 1 and 2, the sensors 36, 38, 40 and GPS receiver 42 are attached to an upper portion of the engine 16 or the cowl 14, which lessens the likelihood of interference with their sensing capabilities from other engine components.

Further comparison of the examples provided in FIGS. 1 and 2 illustrates that the control module 44, 44' can be provided in different locations. In FIG. 1, the control module 44 is provided aboard the marine vessel 22 and may, for example, be a command control module (CCM) that provides control signals for most, if not all, functions and features aboard the marine vessel 22. Alternatively, the control module 44 aboard the marine vessel 22 could be a sub-control module for controlling functions of a sub-system of the marine propulsion system 10. In contrast, in the example of FIG. 2, the control module 44' is mounted to the engine 16. In this example, the control module 44' may be an engine control module (ECM) that provides signals to command functions of the engine 16 and/or outboard motor 12', but does not command functions aboard the marine vessel 22' itself.

Note that while FIG. 1 shows the sensors 36, 38, 40 and GPS receiver 42 located on an upper portion of the engine 16, while FIG. 2 shows the sensors 36, 38, 40 and GPS receiver 42 on the underside 46 of an upper portion of the cowl 14, the embodiments could be flip-flopped, such that the control module 44' mounted to the engine 16 is coupled to sensors 36, 38, 40 and GPS receiver 42 that are mounted to the engine 16 rather than to the cowl 14. Similarly, the control module 44 aboard the marine vessel 22 could be communicatively connected with sensors 36, 38, 40 and GPS receiver 42 that are attached to the cowl 14 instead of being attached to the engine 16. In still another example, the sensors 36, 38, 40 and GPS receiver 42 are coupled to both a control module 44 aboard the marine vessel 22 and to a control module 44' mounted to the engine 16.

In both the embodiments of FIGS. 1 and 2, the control module 44, 44' is programmable and includes a processing system 45 (e.g. processor) and a storage system 47 (e.g. memory). For ease of explanation, only the control module 44 will be described in further detail, it being understood that the explanation applies to control module 44' as well. The control module 44 can be located anywhere in the system 10 and/or located remote from the system 10 and can communicate with various components of the marine vessel via a peripheral interface and wired and/or wireless links, as will be explained further herein below. Although FIGS. 1 and 2 show one control module per system 10, 10', the system can include more than one control module. Portions of the method disclosed herein below can be carried out by a single control module or by several separate control modules. For example, the system can have a control module located at or near a helm of the marine vessel and can also have control module(s) located at or near the outboard motor 12, 12' or (multiple outboard motors) coupled to the transom. If more than one control module is provided, each can control operation of a specific device or sub-system on the marine vessel 22.

In some examples, the control module 44 may include a computing system that includes a processing system 45, storage system 47, software, and input/output (I/O) interface 49 for communicating with peripheral devices. The systems may be implemented in hardware and/or software that carries out a programmed set of instructions. For example, the processing system 45 loads and executes software from the storage system 47, such as software programmed with a method for enhancing marine propulsion system features, which directs the processing system 45 to operate as described herein below in further detail. The computing system may include one or more processors, which may be communicatively connected. The processing system 45 can comprise a microprocessor, including a control unit and a processing unit, and other circuitry, such as semiconductor hardware logic, that retrieves and executes software from the storage system. The processing system 45 can be implemented within a single processing device but can also be distributed across multiple processing devices or sub-systems that cooperate according to existing program instructions. The processing system 45 can include one or many software modules comprising sets of computer executable instructions for carrying out various functions as described herein.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The storage system 47 can comprise any storage media readable by the processing system and capable of storing software. The storage system 47 can include volatile and non-volatile, removable and non-removable media implemented in any method or technology for storage of information, such as computer-readable instructions, data structures, software modules, or other data. The storage system 47 can be implemented as a single storage device or across multiple storage devices or sub-systems. The storage system 47 can include additional elements, such as a memory controller capable of communicating with the processing system 45. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The control module 44 communicates with one or more components of the propulsion system 10 via the 110 interface 49 and a communication link 51, which can be a wired or wireless link. The control module 44 is capable of monitoring and controlling one or more operational characteristics of the control system and its various subsystems by sending and receiving control signals via the communication link 51. In one example, the communication link 51 is a controller area network (CAN) bus, but other types of links could be used. It should be noted that the extent of connections of the communication link 51 shown herein is for schematic purposes only, and the communication link in fact provides communication between the control module and each of the peripheral devices noted herein, although not every connection is shown in the drawing for purposes of clarity.

The control module 44 and various associated software modules functionally convert input signals, such as but not limited to vessel control signals or information from sensors 36, 38, 40 or GPS receiver 42, to output signals, such as but not limited to actuator control signals, according to the computer executable instructions. Each of the input signals can be split into more than one branch, depending on how many functions are to be carried out and/or how many actuators are to be controlled with each of the input signals. The input signals may be fed to several software modules within the control module 44 through branch signals. The exact signals input into the software modules can be taken directly from the corresponding control input device or sensor, or could be pre-processed in some way, for example by scaling through an amplifier or by converting to or from a digital signal or an analog signal using a digital-to-analog or an analog-to-digital converter. It should be appreciated that more than one input signal can be combined to provide an output signal, in which case the individual input signals may be input to the same software modules or may each be provided to an individual software module. Note that in the event that more than one signal is used to generate an output signal, a post-processing module, such as a summer, a selector, or an averaging module is used to combine the input signals into an output signal.

The provided description of the control module 44 is conceptual and should be interpreted generally, as those skilled in the art will recognize many ways to implement such a control module. These include implementation using a digital microprocessor that receives input signals or branch signals and performs a calculation using the input signals to produce the corresponding output signals or actuator control signals. Also, analog computers may be used, which comprise circuit elements arranged to produce the desired outputs. Furthermore, lookup tables containing predetermined or calibrated data points may be stored in any fashion to provide the desired output corresponding to a given input signal.

Figure 3:
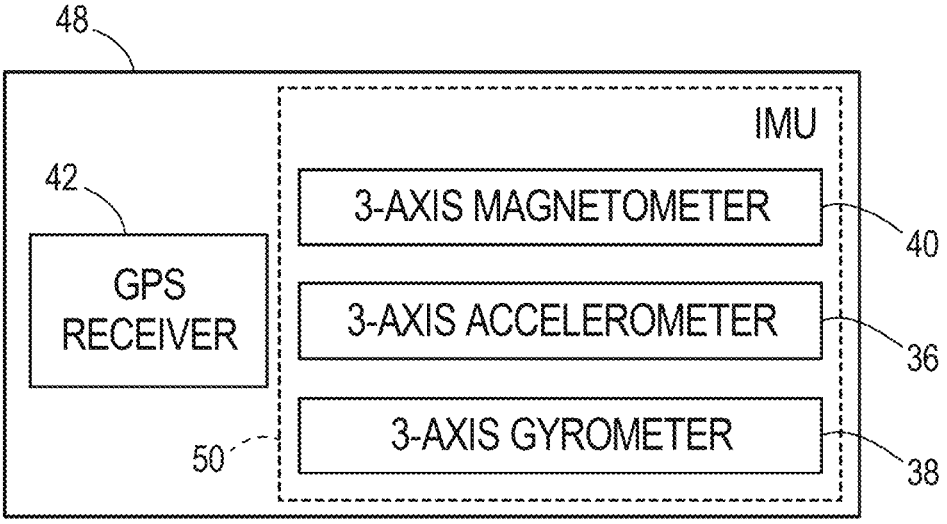
FIG. 3 illustrates one example of a combined unit including both a GPS receiver and an IMU.

Now turning to FIG. 3, one example of a combination device such as an IMU-enabled GPS device 48 will be described. Note that in this example, the at least one motion sensor 36 is embodied by a 3-axis accelerometer, the at least one orientation sensor is embodied by a 3-axis gyrometer, and the at least one directional sensor 40 is embodied by a 3-axis magnetometer. Each of these sensors 36, 38, 40 is combined into an inertial measurement unit IMU 50, although they could be provided separately from one another. Here, the IMU 50 and GPS receiver 42 are integrated as a single device 48. In one example, the device 48 is an attitude and heading reference system (AHRS) that includes an on-board processing system. Note that in other examples, the IMU 50 could be provided separately from the GPS receiver 42, and both could be mounted to either the engine 16 or the cowl 14. In other examples, either the GPS receiver 42 or the IMU 50 is mounted to the cowl 14, while the other of the GPS receiver 42 and the IMU 50 is mounted to the engine 16. Note that the IMU 50 could alternatively be provided without the directional sensor 40 (3-axis magnetometer) and directional information could instead be obtained from the GPS receiver 42.

Figure 4:
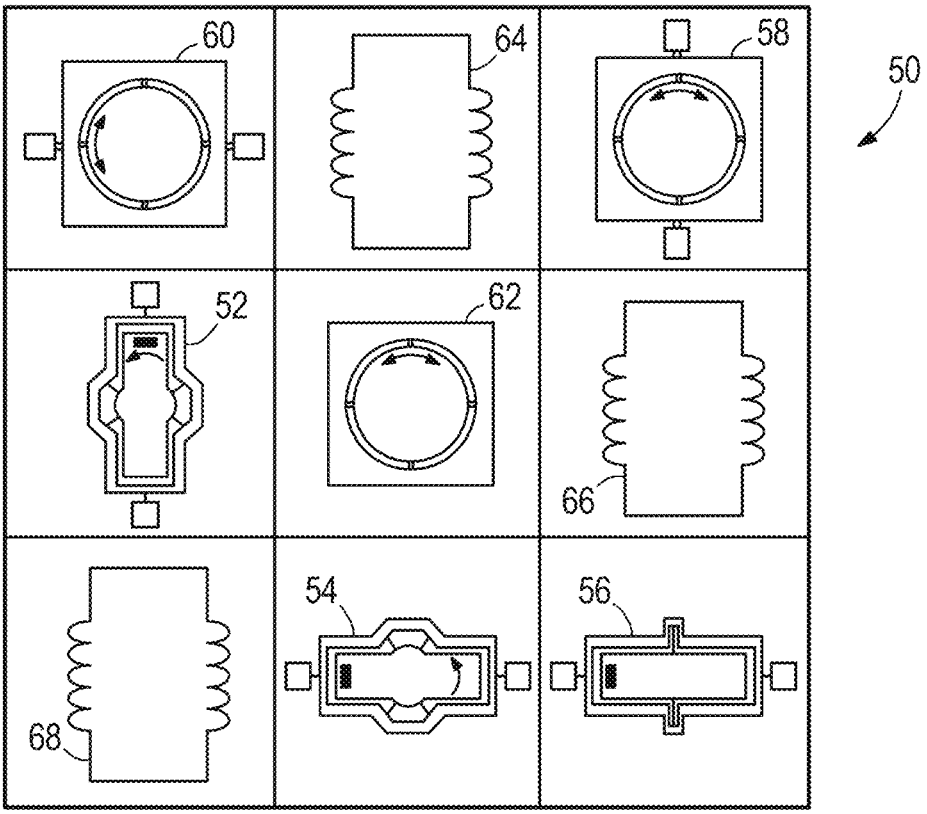
FIG. 4 is a schematic used to illustrate the capabilities of a 9-axis IMU.

FIG. 4 schematically illustrates the functions of the IMU 50 as a device that measures the acceleration, orientation, and direction of the engine 16 or the cowl 14 in nine degrees of freedom. A motion sensor 36 such as a 3-axis accelerometer can measure acceleration of the engine 16 or cowl 14 to which it is attached in each of the X, Y, and Z directions and can provide this information to the control module 44, 44'. This is represented schematically by the presence of an accelerometer $A_X$ 52 that measures acceleration in the X direction, an accelerometer $A_Y$ 54 that measures acceleration in the Y direction, and an accelerometer $A_Z$ 56 that measures acceleration in the Z direction. The accelerometers 52, 54, 56 may be linear and/or angular accelerometers. If linear accelerometers, the accelerometers 52, 54, 56 measure acceleration in the up and down, left and right, and forward and back directions. If angular accelerometers, the accelerometers 52, 54, 56 respectively measure pitch, yaw, and roll. In one example, each of the accelerometers 52, 54, 56 is an MEMS accelerometer.

The orientation sensor 38 can be a 3-axis gyrometer represented by 3 gyroscopes in FIG. 4: a gyro $G_X$ 58 that measures rotational attributes in the X direction, a gyro $G_Y$ 60 that measures rotational attributes in the Y direction, and a gyro $G_Z$ 62 that measures rotational attributes in the Z direction. Each of the gyros 58, 60, 62 detects changes in rotational attributes for example by measuring changes in rate of rotation (i.e., angular velocity). This information can be used to determine the orientation of the cowl 14 or engine 16 to which the gyros 58, 60, 62 are attached. The gyros 58, 60, 62 may be MEMS gyrometers, dynamically tuned gyrometers, or any other type of gyrometer known to those having ordinary skill in the art.

The IMU 50 may further include the directional sensor 40, which may be a compass or a 3-axis magnetometer. The directional sensor 40 is represented schematically in FIG. 4 by magnetometers 64, 66, and 68. The magnetometers 64, 66, 68 can be used to sense information regarding a direction of the engine 16 or the cowl 14 with respect to Earth's magnetic field to determine such direction in the north, south, east, west reference coordinate system. The magnetometers 64, 66, 68 measure the strength of a magnetic field in a specified direction, and provide an output describing an angle between the orientation of the measuring device and Earth's magnetic poles. The magnetometers 64, 66, 68 can be Hall Effect, magnetoresistive, SQUID, fluxgate, or any other type of magnetometer.

As noted, each of the 3-axis accelerometer, the 3-axis gyrometer, and the 3-axis magnetometer of the IMU 50 (together providing measures of the acceleration, orientation, and direction of the engine 16 or cowl 14) and the GPS receiver 42 provide information to the control module 44, 44' for use by the control module 44, 44' in order to control one or more features of a propulsion system 10 for the marine vessel 22. In order for the information provided from the sensors 36, 38, 40 and GPS receiver 42 to have meaning, the IMU 50 and the GPS receiver 42 may be attached to a predetermined location on one of the engine 16 and the cowl 14. The control module 44, 44' may associate this predetermined location with a coordinate system origin for purposes of determining the acceleration, orientation, direction, and global position of the one of the engine 16 and the cowl 14. For example, the control module 44, 44' may be placed at a particular position near the engine's air intake plenum, which position the control module 44, 44' associates with a (0, 0, 0) origin of the engine's coordinate system. Of course, any deterministic mounting of the sensors 36, 38, 40 and GPS receiver 42 can act as a (0, 0, 0) reference point. Anywhere signals to and from the GPS receiver 42 and sensors 36, 38, 40 are not overly obstructed could be chosen for the location of the devices; for example, in addition to be placed on the underside 46 of the cowl 14 or the top surface of the engine 16, the devices could be placed on the upper front side or upper back side of the engine 16.

The features of the propulsion system 10 that could be controlled, realized, or aided by information such as the acceleration, orientation, direction, and global position of the engine 16 or cowl 14 being provided to the control module 44, 44' will now be described. Note that any single one, a combination of two or more, or all of the features described herein below could be provided or enhanced given the information determined by the IMU 50 and/or GPS receiver 42. Note that in different embodiments of the IMU 50, or if only a GPS receiver 42 or only an IMU 50 is provided on the engine 16 or the cowl 14, different features of the propulsion system 10 could be enhanced. Note also that not all sensors would be required in order to provide or enhance a given one of the features described herein below.

Figures 12, 13:
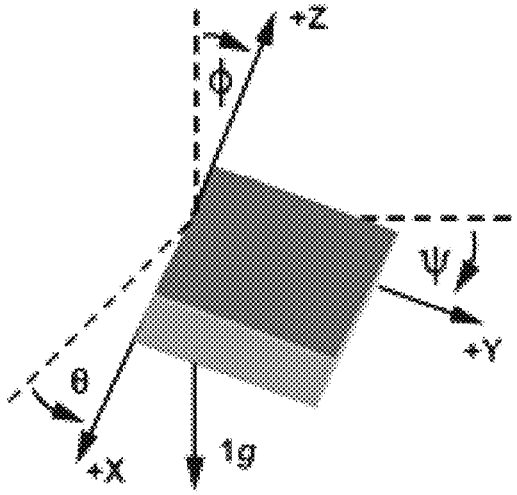
FIG. 12 illustrates a coordinate system for angles for sensing inclination of an outboard motor.
FIG. 13 illustrates a lookup table for determining an oil volume in an oil sump of an outboard motor.

In one example, information from the IMU 50 or from a standalone 3-axis accelerometer can be used to determine an angle of the engine 16 or cowl 14 from gravity (i.e., pitch). Referring to FIG. 12, angles for inclination sensing are defined with respect to the x- and y-axes in the plane of the horizon and the z-axis orthogonal to the horizon. Here, $\theta$ is the angle between the horizon and the x-axis of the accelerometer, $\psi$ is the angle between the horizon and the y-axis of the accelerometer, and $\varphi$ is the angle between the gravity vector and the z-axis. Acceleration in each of the x, y, and z directions can be filtered using a first order filter or averaged over a fixed period of time to obtain an average acceleration in each of the x, y, and z directions ($X_A$, $Y_A$, $Z_A$). Averaging or filtering the accelerometer readings factors out noise inherent in the accelerometers' signals, as the accelerometers 52, 54, 56 move in response to vibrations of the outboard motor 12 when it is running. Assuming that the x-axis in FIG. 12 extends in the left-right direction of the outboard motor 12, the y-axis extends in the front-back direction of the outboard motor 12, and the z-axis is aligned up and down, the angle of inclination $\theta$ from gravity (i.e., pitch) can be calculated using the following equation:

$$\theta = \tan^{-1}\left(\frac{X_A}{\sqrt{Y_A^2 + Z_A^2}}\right)$$

The control module 44, 44' may need to take into account a steady state offset in the angles reported by the accelerometers 52, 54, 56 as they may not be mounted directly in line with the crankshaft, about which the outboard motor 12 rotates.

Figure 5:
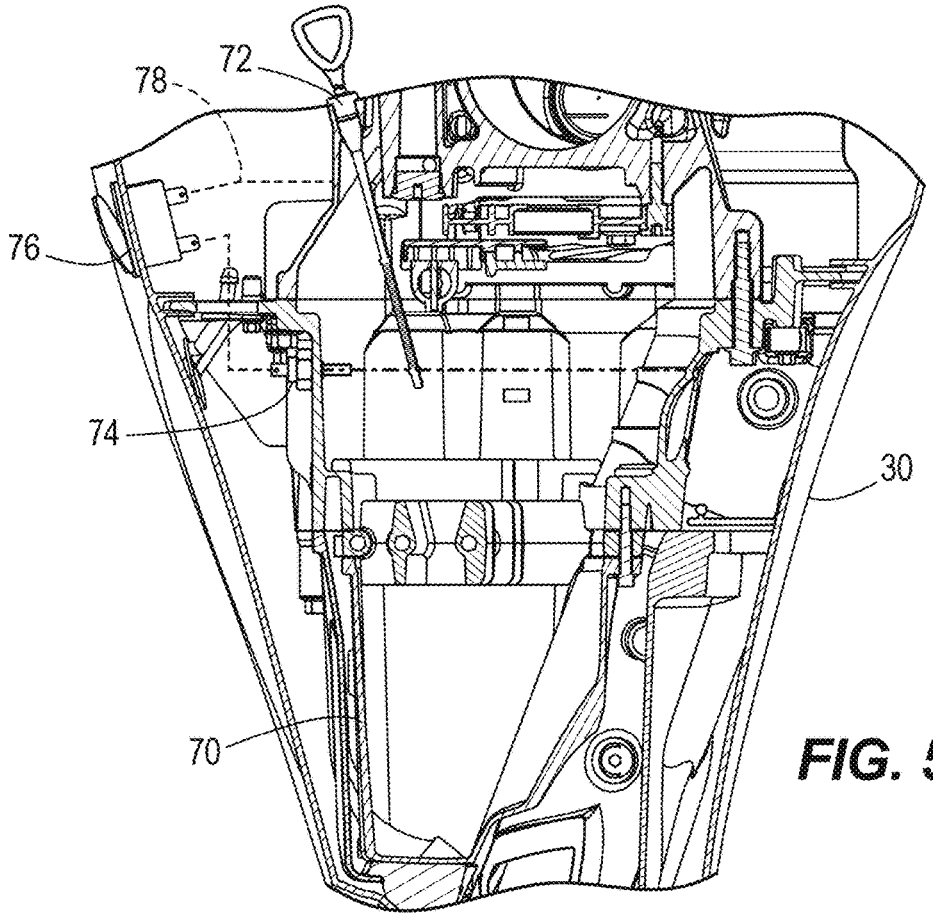
FIG. 5 illustrates a cut-away view of a portion of an outboard motor according to either FIG. 1 or 2.

Referring to FIG. 5, in one example, the control module 44, 44' can use the information regarding the orientation and/or acceleration of the engine 16 (and optionally also the information regarding the direction of the engine 16) to determine an oil level and/or volume in an oil sump 70 of the outboard motor 12. FIG. 5 shows a partially cut-away view of the midsection housing 30 of the outboard motor 12, with the oil sump 70 provided therein. As known to those having ordinary skill in the art, it is desirable to maintain a proper amount of oil in the sump 70 in order to prevent damage to the engine 16 that sits above the sump 70. As such, manufacturers of outboard motors typically recommend that the operator check the oil level in the sump 70 before each use of the outboard motor 12. To facilitate this task, many outboard motors 12 include a dipstick 72 that extends out of the sump 70. The operator can visually check the oil level in the sump 70 by manually withdrawing the dipstick 72 from the sump 70 and visually inspecting the oil residing on the shaft of the dipstick 72. However, most dipsticks have a handle located under the cowl 14 of the outboard motor 12. As such, in order to check the oil level in the sump 70, it is necessary for the operator to remove and replace the cowl 14. This can be a major inconvenience to the operator, especially when the outboard motor 12 and therefore its cowl 14 are rather large and heavy. For this reason, the sump 70 may be provided with an oil level sensor 74 configured to sense the oil level in the sump 70. The oil level sensor 74 can extend through the wall of the sump 70 and can be contacted by and/or immersed in the oil in the sump 70. The oil level sensor 74 can be electrically connected to an input device/indicator 76 on the midsection housing 30 or cowl 14 that indicates the oil level to an operator. The input device/indicator 76 can be connected by way of an electrical connection 78 to the control module 44, 44' and/or to a gauge or other type of instrument aboard the marine vessel 22, although such connections are not shown herein. Further details of the oil level sensor 74 and how it works are included in U.S. Pat. No. 9,193,429, which was incorporated by reference above. In one example, data from the oil level sensor 74 is either filtered using a first order filter or averaged over a fixed period of time to factor out noise.

In one example, the oil level sensor 74 can be used to determine an oil level in the oil sump 70 of the outboard motor 12 even when the outboard motor 12 is tilted or trimmed or on a non-level surface, which might skew an oil level reading. The information regarding the orientation and/or acceleration, and optionally the direction, of the engine 16 can be used along with data describing the inner shape of the oil sump 70 to provide an approximation of the oil level. Note that the size, configuration, and orientation of the sump 70 are not critical and can vary from that which is shown. All that is required is that the control module 44, 44' be provided with an equation or other model describing the inner geometry of the sump 70 for purposes of calculating an oil volume and therefore oil level therein. For example, information from the gyros 58, 60, 62 describing the tilt of the engine 16 in several axes can be used as an approximation of the angle at which the top surface of the oil is tilted, and this information can be used along with information from the oil level sensor 74 and the known geometry of the sump 70 to determine a volume of oil in the sump 70. By way of another example, information from the accelerometers 52, 54, 56 describing the acceleration of the engine 16 in several axes can be used to calculate an approximation of the angle at which the top surface of the oil is tilted, and this information can be used along with information from the oil level sensor 74 and the known geometry of the sump 70 to determine a volume of oil in the sump 70. A direction of the engine 16 as determined by the magnetometers 64, 66, 68 may also be used in conjunction with the orientation information to determine the orientation and shape of the upper surface of the oil. For example, if tilt of the engine 16 is known only in two dimensions, information from one or more magnetometers can be used to provide additional degrees of freedom to an estimate of the orientation of the surface of the oil. Magnetometer information could also be used to provide redundancy to gyroscopic measurement of rotation of the engine 16 about the vertical axis. Additionally, a thermometer may also be used to read the engine temperature, which would indicate if the engine 16 was just running, in which case oil many be draining back into the sump 70 and affecting the oil level reading.

Note that it may be preferable to use the sensed orientation and/or acceleration of the engine 16 instead of the sensed orientation and/or acceleration of the cowl 14 for oil sensing purposes, seeing as the orientation and/or acceleration of the cowl 14 may be different than that of the engine 16 if the cowl 14 is partially or fully removed from the midsection housing 30. Note too that a simple trim sensor would likely not be adequate to provide the orientation of the engine 16 for purposes of calculating the oil level in the sump 70. This is because if the vessel 22 is not level, such as if it is on a trailer that is not on level ground or if it is on a boat ramp, this will affect the oil level reading even if the outboard motor 12 is not trimmed or tilted. Certainly, the oil level reading will also be affected if the outboard motor 12 is both trimmed and turned from center. In contrast, an orientation and/or acceleration sensor would be able to account for the angle of the engine 16 due to the inclination of the entire vessel 22 and due to the tilt/trim position of the outboard motor 12 as well as the tilt of the outboard motor 12 due to steering offset. The information from the orientation and/or acceleration sensor compensates for any differences in transom angle that might affect the angle of the outboard motor and compensates for situations in which the entire marine vessel 22 is at an angle by returning information that can be used to determine the outboard motor's angle from gravity.

In one particular example, the data from the oil level sensor 74 and the calculated angle θ of the engine 16 or cowl 14 from gravity can be fed into a 2D lookup table to determine the oil volume. See FIG. 13. The oil volume values in the 2D lookup table can be determined using the equation or other model describing the inner geometry of the sump 70 or can be determined empirically. The measured oil volume can then be displayed to the user via a gauge and/or could be used to trigger "low oil volume" faults (also to be displayed to the user via a gauge) if the oil volume is lower than a predetermined threshold. In other examples, other fluid volumes in the engine 16 could be determined using the same strategy, such as for example a volume of the transmission fluid.

In another example, it may be desirable to determine if a reading of the oil level in the oil sump 70 can be displayed to an operator of the marine vessel 22 by using the information regarding the orientation and/or acceleration of the engine 16. In this instance, the geometry of the sump 70 would not need to be known, nor would the volume calculations need to be performed. Rather, a simple indication could be provided to the operator that the oil level cannot be sensed because the engine 16 is not level. In one example, the acceleration of the engine 16 or cowl 14 is used to determine its pitch (angle θ) as described herein above. If this angle is above a predetermined threshold, the control module 44, 44' may determine that the sensor's reading is not reliable and should not be used. The indication that the oil level cannot be accurately sensed could be provided via the same indicator 76 or gauge mentioned above. On the other hand, if the engine 16 is level, the control module 44, 44' could allow the sensed oil level to be displayed. This feature may be particularly useful when a float-type oil level sensor is used, because as the sensor is tipped, it becomes less reliable as the float is no longer moving up and down the measurement rod.

Figure 6:
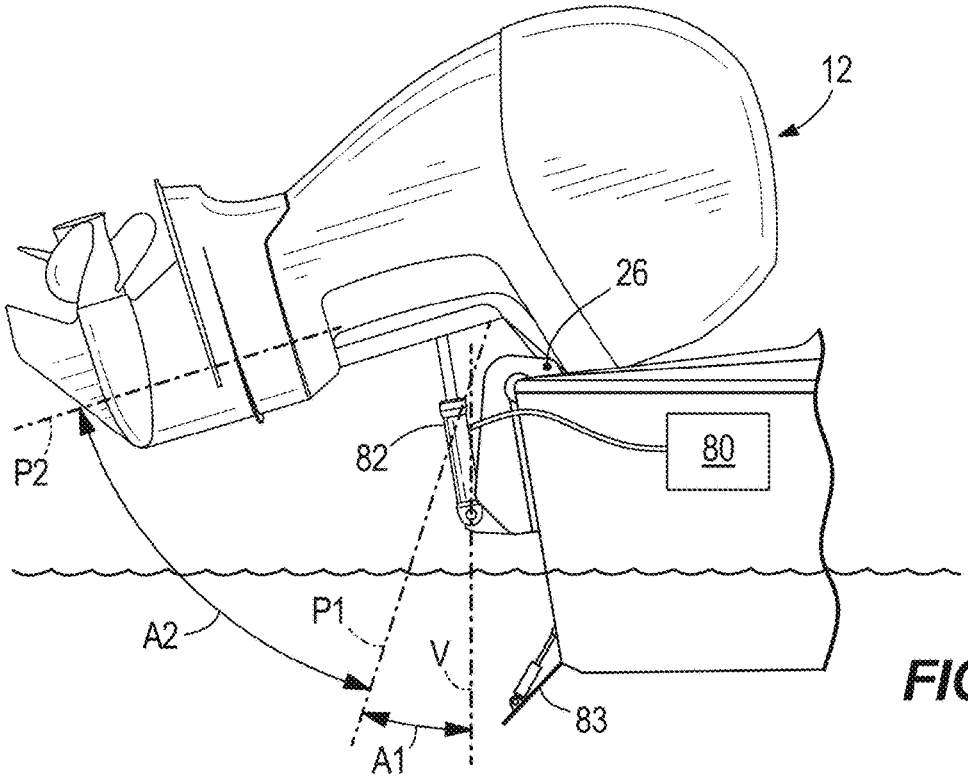
FIG. 6 illustrates an outboard motor that is tilted about a tilt-trim axis.

Turning to FIG. 6, the control module 44, 44' may also use the information regarding the orientation and/or acceleration of the one of the one of the engine 16 and the cowl 14 to determine a trim position of the outboard motor 12. FIG. 6 shows an example in which a pump-motor combination 80 is used to provide fluid to a trim cylinder 82, which raises and lowers the outboard motor 12 about the tilt-trim axis 26. The outboard motor 12 can be trimmed away from a vertical orientation represented by the dashed line V through a maximum trim angle A1 to the maximum trim position P1, and through a maximum tilt angle A2 to the maximum tilt position P2. Actuation of the trim system, including pump-motor combination 80 and trim cylinder 82, can be in response to manual inputs to a trim input device, or in response to commands from an automatic trim control system, which trims the outboard motor 12 up and down based on different vessel operating conditions. In an auto-trim system, a trim control algorithm might utilize feedback from a trim sensor to determine if a trim setpoint has been reached. One example of such a trim sensor is provided in U.S. Pat. No. 4,005,674, which was incorporated by reference above. Some examples of auto-trim systems are described in U.S. Pat. Nos. 7,416,456; 9,919,781; and 9,751,605, each of which is incorporated herein by reference.

Generally, the weakest link in a trim system is the trim sensor. Whether the trim sensor is a rheostat or a Hall Effect sensor, it is generally prone to water intrusion. If the trim sensor fails, the auto-trim functionality is disabled and the operator must replace or dry out the trim sensor before auto-trim can be re-enabled. Otherwise, the operator can use manual trim commands, for which feedback from the trim sensor is not required. Information from the IMU 50 (or from a standalone gyrometer and/or accelerometer) regarding the orientation and/or acceleration of the engine 16 or the cowl 14 can be used with an auto-trim system in different ways. This information can provide trim sensor redundancy, such that when the existing trim sensor fails a rationality check, or when a comparison shows that the angle of the outboard motor as determined from the information from the IMU 50 is not the same as or does not correspond to the information from the existing trim sensor, the information from the IMU 50 or from a standalone gyrometer and/or accelerometer would instead be used to determine the angle of the outboard motor 12. In other examples, trim sensors may be done away with altogether, and IMUs 50 or standalone gyrometers and/or accelerometers may be used in their place to provide trim position information for each outboard motor 12.

Typical trim sensors measure an angle of the outboard motor 12 relative to its mounting assembly 24. However, different transom angles cause the mounting assembly 24 to be at different angles with respect to gravity when on different marine vessels. The information from the IMU 50 or a standalone gyrometer and/or accelerometer can be used to more accurately measure the outboard motor's angle from gravity using a trim sensor 27. For example, the fully trimmed down position of an outboard motor 12 can be adapted by noting when the outboard motor 12 is being commanded to trim down, but the reading from the trim sensor has not changed by more than a calibrated amount in a calibrated amount of time. In one example, in response to the outboard motor being fully trimmed down and the marine vessel 22 operating at a speed below a predetermined threshold, the control module 44, 44' determines a baseline angle of the outboard motor 12 from gravity (i.e., a baseline pitch) by filtering or averaging measurements from the accelerometers 52, 54, 56 and plugging this data into the equation provided above. Note that ensuring the marine vessel 22 is operating below a predetermined speed ensures that the marine vessel 22 itself is substantially parallel to the horizon. The baseline angle θ, thus determined, can then be added to the angle that the trim sensor 27 determines for subsequent trim measurements. For example, even when accelerometer data is not available during subsequent trim measurements, the outboard motor's angle from gravity can be determined by adding the baseline angle θ of the outboard motor 12 from gravity to the current angle as determined by the trim sensor 27. (Note that the angle θ may be a negative number depending on the reference axes chosen.)

Having more precise information about the trim of the outboard motor 12 can be especially useful when more than one outboard motor is mounted on a single marine vessel's transom, and information related to trim is used to prevent the motors from hitting one another as they are trimmed and/or steered independently of one another. For instance, if two or more outboard motors have the same trim angle as determined by trim sensors, but different angles from gravity as determined from accelerometers 52, 54, 56, the difference between the trim sensor value and the angle from gravity can be used to adjust the readings from the trim sensor such that any comparisons between the outboard motors' trim positions factor in any differences in position of the outboard motors on the transom.

Figure 7:
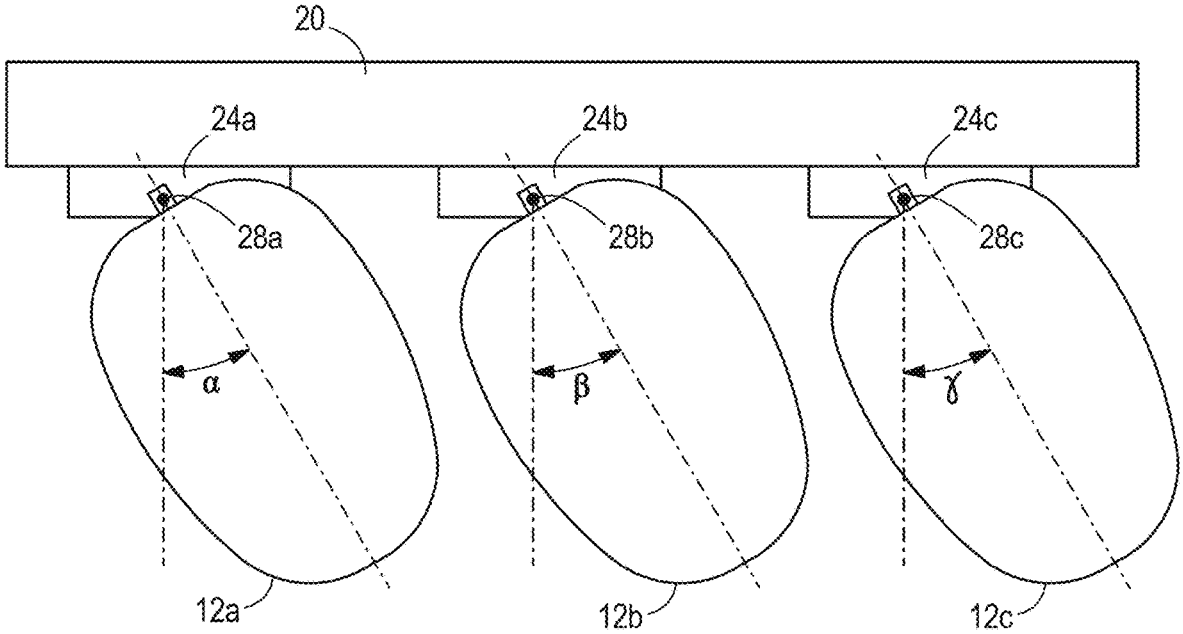
FIG. 7 illustrates a top view of three outboard motors that are rotated to respective steering positions.

FIG. 7 shows three outboard motors 12*a*, 12*b*, 12*c* coupled to a transom 20 by way of mounting assemblies 24*a*, 24*b*, 24*c*. Note that each of the outboard motors 12*a*, 12*b*, 12*c* is rotated about its steering axis 28*a*, 28*b*, or 28*c*, respectively, to a respective steering angle α, β, or γ. With reference to FIG. 7, it will be described how information from the IMU 50 can be used to enhance steering functions of the propulsion system 10 as the outboard motors 12*a*, 12*b*, 12*c* rotate about their steering axes 28*a*, 28*b*, 28*c* according to commands from a steering wheel, joystick, autopilot system, or the like. For example, the control module 44, 44' can use the information regarding the direction of the engine 16 or cowl 14 in order to determine the steering angles α, β, and γ of the outboard motors 12*a*, 12*b*, 12*c*. Generally, steering angle sensors used today are Hall Effect sensors and are prone to vibration-related failures. The information from the IMU 50 could be used when a typical steering angle sensor fails, which can be determined by way of a rationality check or a comparison as described herein above with respect to trim sensor redundancy. Alternatively, steering angle sensors could be eliminated altogether and IMUs 50 on each outboard motor 12*a*, 12*b*, 12*c* could be used in their place to provide direction information.

The IMUs 50 on each outboard motor 12*a*, 12*b*, 12*c* could communicate over a CAN bus or wirelessly with an IMU on the marine vessel 22 in order to provide a reference for the IMUs 50 on each outboard motor 12*a*, 12*b*, 12*c*. Because the relative coordinates of each of the IMUs on the outboard motors 12*a*, 12*b*, 12*c* and the IMU on the marine vessel 22 would be known in relation to one another, this would allow the control module 44, 44' to determine the steering angles of the outboard motors 12*a*, 12*b*, 12*c* with respect to the transom 20. The steering angle information from the directional sensors 40 in the IMUs 50 could be used to tune existing toe angle and steering angle algorithms to provide better vessel handling.

Referring to both FIGS. 6 and 7, it can be seen that the thrust vector produced by the propeller 18 of an outboard motor 12 will depend on both its trim angle and its steering angle. Optimizing trim angle and tab angle are generally of concern when operating a marine vessel in order to maintain an inclination from the horizon at which the vessel will cruise most efficiently. Generally, an inclination of about 5 degrees from horizontal (i.e., the bow of the vessel 22 is raised about 5 degrees from horizontal) can be achieved by trimming the outboard motor 12 (or motors 12*a*, 12*b*, 12*c*). However, the positions of trim tabs in the water (see, for example trim tab 83, FIG. 6) may change the vessel's inclination angle and thus the thrust angle of the propellers 18 with respect to horizontal in a way that is not determinable from trim sensor readings. This makes it difficult for the operator to know if the propeller 18 is positioned such that it produces an efficient thrust vector. Thus, the control module 44, 44' could use the information regarding the orientation of the engine 16 or the cowl 14, and in some examples the information regarding the direction of the engine 16 or cowl 14, in order to determine an angle of thrust of the propeller 18 with respect to horizontal. Real-time feedback information regarding the actual orientation of the outboard motor 12 and therefore the thrust of its propeller 18 will help the operator adjust the outboard motor 12 to the most efficient trim angle. Alternatively, the propulsion system 10 can be programmed to actuate the trim tabs 83 or the outboard motors 12*a*, 12*b*, 12*c* automatically to angles that will optimize the vessel's inclination in the water.

Figure 8:
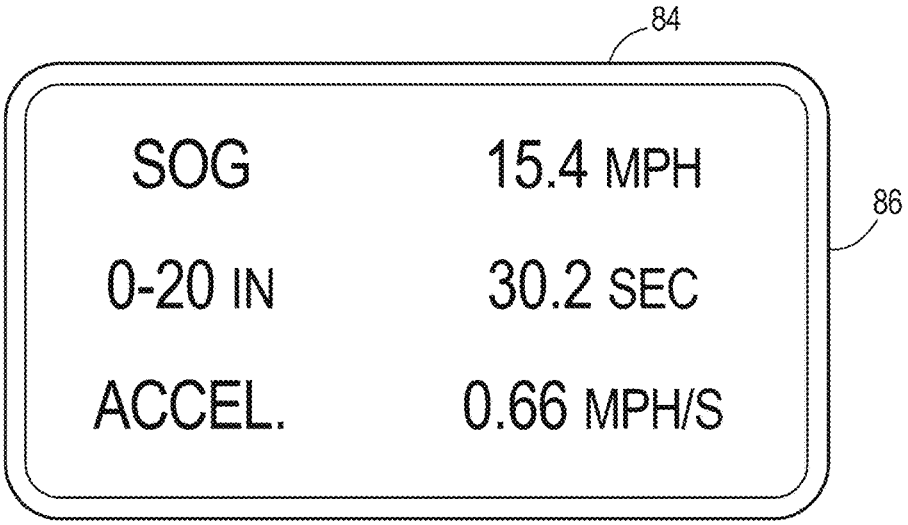
FIG. 8 illustrates one example of a gauge for indicating boat performance data to an operator of a marine propulsion system.

In yet another example, referring to FIG. 8, a gauge 84 may be provided aboard the marine vessel 22 that indicates boat performance data to an operator of the marine propulsion system 10. The gauge 84 may include a screen 86 upon which such boat performance data may appear, for example in a digital format (e.g. LED, LCD, etc.). In other examples, the gauge 84 may comprise a dial that points to numbers printed on the screen 86 of the gauge 84. According to the present disclosure, the control module 44, 44' may use the information regarding the acceleration and the global position of the engine 16 or the cowl 14 to calculate the boat performance data. For example, the boat performance data may include a speed over ground (SOG) of the vessel 22, which may be determined by noting the location of the engine 16 or cowl 14 at two points in time using the GPS receiver 42 and dividing the distance between the two locations by the travel time. The gauge 84 may also display performance statistics to the operator, such as the time that it took for the vessel 22 to accelerate from 0 MPH to 20 MPH. This information can be determined using a timer and information from the motion sensor (i.e., accelerometers) and/or GPS receiver 42. The acceleration of the vessel 22 can also be displayed on the gauge 84, which can be determined directly from the accelerometers 52, 54, 56, or can be calculated by using velocity and elapsed time information from the GPS receiver 42.

Not only can the information regarding speed over ground and acceleration be provided on the screen 86 of the gauge 84 for entertainment purposes, such information can also enable an operator to pick an optimal propeller 18 for a given vessel 22. For example, the operator may install a first propeller 18 on the outboard motor 12, accelerate from 0 MPH to a given speed, note the time that it took reach the given speed, repeat the process for a second propeller, and choose the propeller that provides faster acceleration. The operator could also use the information provided on the gauge 84 to determine when the propeller 18 has been damaged and therefore needs to be reworked or replaced. For example, the operator may note that the 0 to 20 MPH time is longer than usual, all else being constant, and may therefore be prompted to examine his propeller 18 for damage or wear.

Figure 9:
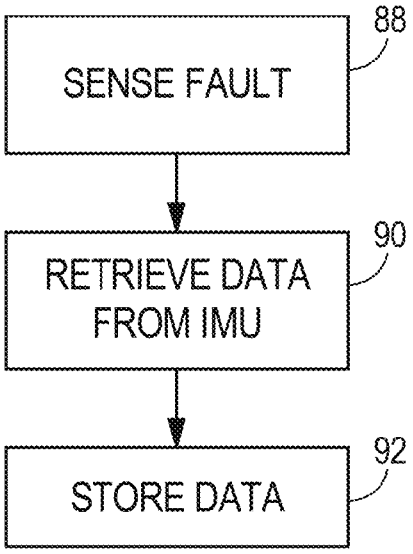
FIGS. 9 and 10 illustrate examples of methods for storing outboard motor operating data according to the present disclosure.
Figure 10:
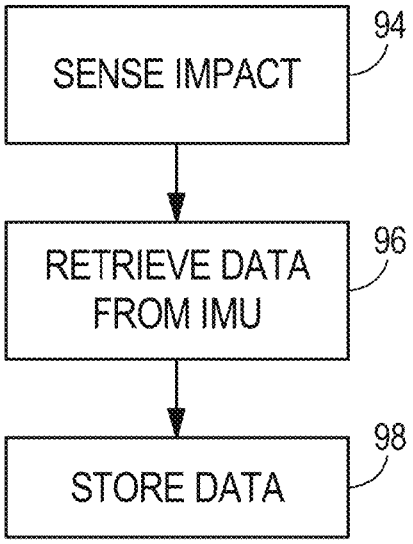

FIGS. 9 and 10 are now referred to describe how information from the GPS receiver 42 and IMU 50 can be helpful in the event of a fault or a crash. FIG. 9 shows an example in which if an engine fault is sensed at 88, data can then be retrieved from the IMU 50, as shown at 90. This data can then be stored, as shown at 92, for later retrieval by a manufacturer, who can look at the running conditions of the outboard motor 12 prior to the fault and attempt to re-create the fault to determine if the outboard motor 12 malfunctioned, if there was operator error, or if some other reason for the fault exists. The information retrieved in response to a fault generally includes the rotational speed of the engine, the trim angle, the oil temperature, and throttle position. However, with information from the IMU 50, the acceleration, orientation, boat attitude, redundant trim angle, and direction of the engine 16 or cowl 14 can also be provided to the manufacturer, thus enabling even more accurate re-creation of the pre-fault conditions.

FIG. 10 illustrates how the control module 44, 44' may record operating conditions of the engine 16 in a memory in response to the at least one motion sensor 36 sensing an abrupt decrease in the acceleration (i.e., impact) of the one of the engine 16 and the cowl 14. In one example, impact is detected upon deceleration in the fore or aft direction (y-axis, FIG. 12) exceeds a predetermined threshold. For example, upon sensing an impact as shown at 94, the control module 44, 44' may retrieve data from the IMU 50, as indicated at 96. This data can then be stored, as shown at 98, for later inspection by a police officer or other individual who wishes to re-create the accident scene or understand the operating conditions just prior to impact. For example, the person reviewing the information will have access to the acceleration of the engine 16 or cowl 14 just prior to impact, in what direction the engine 16 or cowl 14 was moving just prior to impact, the speed of the engine 16 or cowl 14 just prior to impact, as well as other information noted herein above, due to the information from the IMU 50 and the GPS receiver 42. Time stamped vectoring and impact force data at the time of the accident can also be obtained.

In another example, information from the accelerometers 52, 54, 56 can be used in conjunction with information from the trim sensor 27 to determine if the outboard motor 12 has hit a log or other underwater object. When the outboard motor 12 hits an underwater object, it rotates up and then back down very quickly (i.e., trail over). The rate of change in trim sensed by the trim sensor 27 is nearly as quick as if the trim sensor 27 signal was momentarily unavailable due to a fault, and therefore it is not possible to tell simply from a change in the trim sensor reading whether an object was indeed struck. Pairing a large change in the trim sensor reading with a rapid change in the data from the accelerometer can help determine if an object was in fact struck. For instance, if the rate of change in trim as sensed by the trim sensor 27 is above a threshold, and the rate of change of pitch of the outboard motor 12 as reported by the accelerometer is also above a threshold, the control module 44, 44' will determine than an object was hit, and will display a notification to the operator via the gauge 84.

The information from the IMU 50 and GPS receiver 42 can be used for many other purposes, including using information regarding the acceleration of the engine 16 to determine if the engine 16 misfires. Misfire is currently detected using crank angle or knock sensors, but an accelerometer in the IMU 50 could instead be used to determine when key frequencies emanate form the engine 16, indicating that there was a misfire. This acceleration information can be analyzed according to the methods described in U.S.

Pat. Nos. 6,285,947 and 6,275,765, which were incorporated by reference herein above. Information regarding speed over ground from the GPS receiver 42 can also be provided to the control module 44, 44' to aid in anti-shift stall algorithms and anti-water ingestion strategies.

Figure 11:
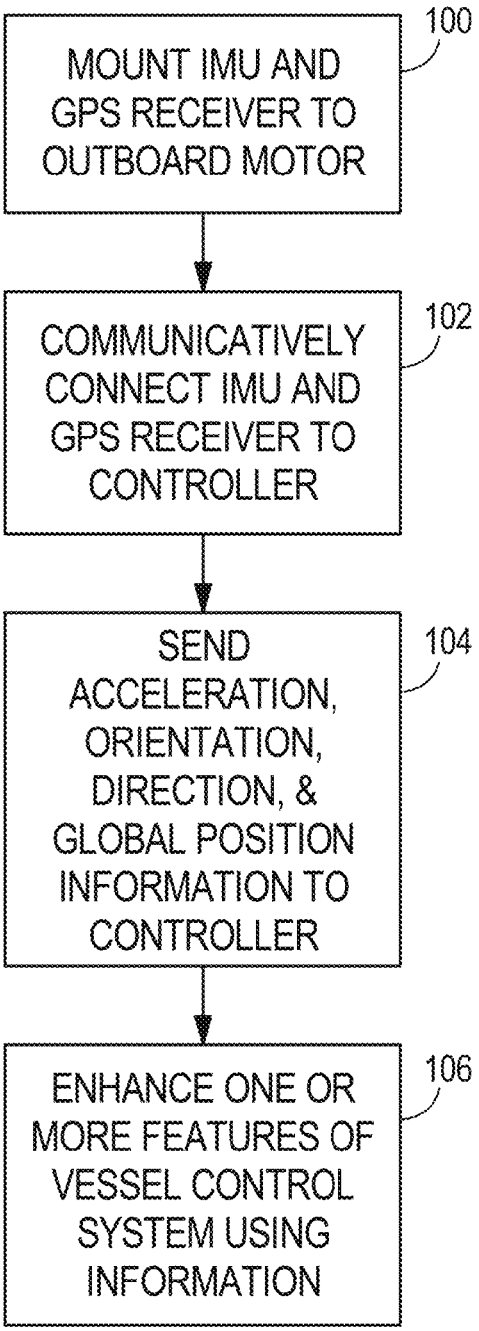
FIG. 11 illustrates an example of a method for enhancing one or more features of a marine propulsion system using information from an IMU and a GPS receiver.

FIG. 11 illustrates a method for controlling one or more features of a propulsion system 10 for a marine vessel 22 having an outboard motor 12 coupled to its transom 20. The method includes, as shown at 100, mounting an inertial measurement unit (IMU) 50 and a global positioning system (GPS) receiver 42 to the outboard motor 12. As noted herein above, the devices could be mounted to either the engine 16 or the cowl 14. As shown at 102, the method includes communicatively connecting the IMU 50 and the GPS receiver 42 to a control module 44, 44'. As shown at 104, the method next includes sending information regarding an acceleration, an orientation, a direction with respect to Earth's magnetic field, and a global position of the outboard motor 12 from the IMU 50 and the GPS receiver 42 to the control module 44, 44'. The method also includes, as shown at 106, enhancing the one or more features of the propulsion system with the control module 44, 44' using the information regarding the acceleration, orientation, direction, and global position of the outboard motor 12.

As noted herein above, these features may include sensing when the outboard motor 12 experiences impact and responsively saving operating conditions of the outboard motor 12 in a memory, sensing when an engine 16 of the outboard motor 12 misfires and responsively sending a notification to an operator of the marine vessel 22, and determining boat performance data that is thereafter displayed to the operator via a gauge 84, each of which may be enhanced using the acceleration information of the outboard motor 12 from the accelerometers of the IMU 50.

Other features that may be enhanced include sensing an oil level in an oil sump 70 of the outboard motor 12, determining if a reading of the oil level in the oil sump 70 can be displayed to an operator of the marine vessel 22, determining a trim position of the outboard motor 12 and responsively selecting whether to adjust the trim position, and determining an angle of thrust of a propeller 18 of the outboard motor 12 with respect to horizontal and responsively selecting whether to adjust one of the trim position of the outboard motor 12 and a tab angle of a trim tab 83 coupled to the transom 20. Each of these features may be enhanced using the information regarding the orientation of the outboard motor 12 as determined by the gyrometer in the IMU 50.

The method may also include using the direction of the outboard motor 12, as determined from the GPS receiver 42 and/or the magnetometer in the IMU 50, to determine a steering angle of the outboard motor 12 and responsively select whether to adjust the steering angle.

In the above description certain terms have been used for brevity, clarity and understanding. No unnecessary limitations are to be implied therefrom beyond the requirement of the prior art because such terms are used for descriptive purposes only and are intended to be broadly construed. The different systems and methods described herein above may be used in alone or in combination with other systems and methods. Various equivalents, alternatives and modifications are possible within the scope of the appended claims. While each of the method claims includes a specific series of steps for accomplishing certain control system functions, the scope of this disclosure is not intended to be bound by the literal order or literal content of steps described herein, and non-substantial differences or changes still fall within the scope of the disclosure.

What is claimed is:

1. A marine propulsion system for a marine vessel, the marine propulsion system comprising:

an outboard motor including a cowl covering an internal combustion engine that powers the outboard motor;

at least one sensor coupled to the outboard motor; and a control module in signal communication with the at least one sensor;

wherein the at least one sensor is attached to one of the engine and the cowl;

wherein the at least one sensor provides information related to a pitch of the one of the engine and the cowl to the control module;

wherein the control module uses the information related to the pitch of the one of the engine and the cowl to do at least one of the following:

determine an angle of the outboard motor with respect to gravity;

determine an amount of oil in an oil sump of the outboard motor; and determine if a reading related to the amount of oil in the oil sump is accurate; and wherein the control module stores a baseline pitch of the one of the engine and the cowl in response to the outboard motor being fully trimmed down and the marine vessel operating at a speed below a predetermined threshold.

2. The marine propulsion system of claim 1, wherein the at least one sensor is an accelerometer providing information regarding an acceleration of the one of the engine and the cowl to the control module.

3. The marine propulsion system of claim 2, further comprising an inertial measurement unit (IMU) that contains the accelerometer.

4. The marine propulsion system of claim 3, further comprising a global positioning system (GPS) receiver attached to the one of the engine and the cowl that provides information regarding a global position of the one of the engine and the cowl to the control module.

5. The marine propulsion system of claim 4, wherein the IMU and the GPS receiver are integrated as a single device.

6. The marine propulsion system of claim 4, further comprising a gauge that indicates boat performance data to an operator of the marine propulsion system;

wherein the control module uses the information regarding the acceleration and the global position of the one of the engine and the cowl to calculate the boat performance data.

7. The marine propulsion system of claim 4, wherein the accelerometer and the GPS receiver are attached to a predetermined location on the one of the engine and the cowl, and the control module associates the predetermined location with a coordinate system origin for purposes of determining the acceleration and the global position of the one of the engine and the cowl.

8. The marine propulsion system of claim 7, wherein the accelerometer and the GPS receiver are attached to an upper portion of the one of the engine and the cowl.

9. The marine propulsion system of claim 3, wherein the IMU further comprises a gyrometer and a magnetometer.

10. The marine propulsion system of claim 2, wherein the control module records operating conditions of the engine in a memory in response to the accelerometer sensing an abrupt decrease in the acceleration of the one of the engine and the cowl.

11. The marine propulsion system of claim 2, wherein the control module uses the information regarding the acceleration of the one of the engine and the cowl to determine the angle of the outboard motor with respect to gravity in response to a trim sensor failing a rationality check or in response to a comparison showing that information from the trim sensor differs from the information from the accelerometer.

12. The marine propulsion system of claim 1, further comprising an oil level sensor that provides the reading related to the amount of oil in the oil sump to the control module, wherein the control module inputs the information related to the pitch of the one of the engine and the cowl and the reading related to the amount of oil in the oil sump into a lookup table to determine the amount of oil in the oil sump.

13. The marine propulsion system of claim 1, wherein the control module determines that the reading related to the amount of oil in the oil sump is not accurate in response to the pitch of the one of the engine and the cowl exceeding a predetermined threshold.

14. The marine propulsion system of claim 1, further comprising a trim sensor sensing an angle of rotation of the outboard motor with respect to a mounting assembly that couples the outboard motor to the marine vessel, wherein the control module adds the baseline pitch of the one of the engine and the cowl to the angle of rotation sensed by the trim sensor to determine the angle of the outboard motor with respect to gravity.

15. A marine propulsion system for a marine vessel, the marine propulsion system comprising:

an outboard motor including a cowl covering an internal combustion engine that powers the outboard motor;

an accelerometer mounted to the outboard motor; and a control module communicatively connected to the accelerometer;

wherein the control module receives information regarding an acceleration of the outboard motor from the accelerometer;

wherein the control module uses the information regarding the acceleration of the outboard motor to do at least one of the following:

determine an angle of the outboard motor with respect to gravity;

determine an amount of oil in an oil sump of the outboard motor; and determine if a reading of the amount of oil in the oil sump is accurate; and wherein the control module uses the information regarding the acceleration of the outboard motor to determine the angle of the outboard motor with respect to gravity in response to a trim sensor failing a rationality check or in response to a comparison showing that information from the trim sensor differs from the information from the accelerometer.

16. The marine propulsion system of claim 15, wherein the control module uses the information regarding the acceleration of the outboard motor to do at least one of the following:

sense when the outboard motor experiences impact and responsively save operating conditions of the outboard motor in a memory;

sense when the engine misfires and responsively send a notification to an operator of the marine vessel; and determine boat performance data that is thereafter displayed to the operator via a gauge.

17. The marine propulsion system of claim 15, wherein the accelerometer is attached to one of the cowl and the engine.

18. The marine propulsion system of claim 15, wherein the control module determines a pitch of the outboard motor using the information regarding the acceleration of the outboard motor.

19. A marine propulsion system for a marine vessel, the marine propulsion system comprising:

an outboard motor including a cowl covering an internal combustion engine that powers the outboard motor;

at least one sensor coupled to the outboard motor; and a control module in signal communication with the at least one sensor;

wherein the at least one sensor is attached to one of the engine and the cowl;

wherein the at least one sensor provides information related to a pitch of the one of the engine and the cowl to the control module;

wherein the control module uses the information related to the pitch of the one of the engine and the cowl to do at least one of the following:

determine an angle of the outboard motor with respect to gravity;

determine an amount of oil in an oil sump of the outboard motor; and determine if a reading related to the amount of oil in the oil sump is accurate;

wherein the at least one sensor is an accelerometer providing information regarding an acceleration of the one of the engine and the cowl to the control module; and wherein the control module uses the information regarding the acceleration of the one of the engine and the cowl to determine the angle of the outboard motor with respect to gravity in response to a trim sensor failing a rationality check or in response to a comparison showing that information from the trim sensor differs from the information from the accelerometer.

* * * * *